US008726882B2

(12) United States Patent
Raasch

(10) Patent No.: US 8,726,882 B2
(45) Date of Patent: May 20, 2014

(54) ENGINE SPEED CONTROL SYSTEM

(75) Inventor: Jason J. Raasch, Cedarburg, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 1100 days.

(21) Appl. No.: 12/725,311

(22) Filed: Mar. 16, 2010

(65) Prior Publication Data

US 2011/0226217 A1 Sep. 22, 2011

(51) Int. Cl.

| | |
|---|---|
| ***F02M 17/04*** | (2006.01) |
| ***F02D 11/04*** | (2006.01) |
| ***F02D 9/10*** | (2006.01) |

(52) U.S. Cl.

CPC ..... *F02M 17/04* (2013.01); *F02D 9/1065* (2013.01); *F02D 11/04* (2013.01)

USPC ..... 123/389; 123/400; 123/437

(58) Field of Classification Search

CPC ..... F02D 9/1065; F02D 11/04; F02M 17/04

USPC ..... 123/73 AD, 389, 390, 391, 400, 401, 123/402, 403, 701, 702, 437, 439, 441; 261/36.2, 119.2

See application file for complete search history.

(56) References Cited

U.S. PATENT DOCUMENTS

| | | | |
|---|---|---|---|
| 1,128,782 | A | 2/1915 | Hanford |
| 1,265,883 | A | 5/1918 | Church |
| 1,745,492 | A | 2/1930 | Kelch et al. |
| 1,982,945 | A | 12/1934 | Armstrong |
| 2,009,659 | A | 7/1935 | Hill et al. |
| 2,022,094 | A | 11/1935 | Shoemaker et al. |
| 2,134,889 | A | 11/1938 | Phillips |
| 2,138,100 | A | 11/1938 | Howard |
| 2,221,201 | A | 11/1940 | Pope, Jr. et al. |
| 2,241,096 | A | 5/1941 | McCullough |
| 2,338,912 | A | 1/1944 | Ericson |
| 2,367,606 | A | 1/1945 | Olson |
| 2,382,952 | A | 8/1945 | Armstrong |
| 2,397,208 | A | 3/1946 | Saco et al. |
| 2,499,263 | A | 2/1950 | Troy |
| 2,529,437 | A | 11/1950 | Weinberger |

(Continued)

FOREIGN PATENT DOCUMENTS

| | | |
|---|---|---|
| GB | 14914 | 10/1915 |
| JP | 61-207836 | 9/1986 |
| JP | 11-093750 | 4/1999 |
| SU | 853138 | 8/1981 |
| SU | 1740741 A1 | 6/1992 |

OTHER PUBLICATIONS

International Search Report and Written Opinion for International Application No. PCT/US12/33891, mail date Aug. 9, 2012, 6 pages.

(Continued)

*Primary Examiner* — Hai Huynh

(74) *Attorney, Agent, or Firm* — Foley & Lardner LLP

(57) ABSTRACT

An engine includes a throttle assembly, a governor, and an actuator. The throttle assembly is designed to at least partially control a fuel flow rate of the engine. The governor is designed to sense a speed of the engine and at least partially control the throttle assembly as a function of the engine speed. The actuator is designed to sense a manifold vacuum pressure of the engine and at least partially control the throttle assembly as a function of the vacuum pressure.

17 Claims, 15 Drawing Sheets

(56) References Cited

U.S. PATENT DOCUMENTS

| | | | | |
|---|---|---|---|---|
| 2,533,180 | A | | 12/1950 | Rhodes |
| 2,544,607 | A | | 3/1951 | Mallory |
| 2,585,814 | A | | 2/1952 | McDonald |
| 2,613,657 | A | | 10/1952 | Sloane et al. |
| 2,635,596 | A | | 4/1953 | Adler |
| 2,716,397 | A | | 8/1955 | Heinish |
| 2,781,751 | A | | 2/1957 | Benjamin |
| 2,804,552 | A | | 8/1957 | McFarland |
| 2,837,070 | A | | 6/1958 | Agar |
| 2,867,196 | A | | 1/1959 | Francis |
| 2,947,600 | A | | 8/1960 | Clayton |
| 3,139,079 | A | | 6/1964 | Bettoni |
| 3,209,532 | A | | 10/1965 | Morris et al. |
| 3,217,652 | A | | 11/1965 | Olson |
| 3,242,741 | A | | 3/1966 | Catterson |
| 3,276,439 | A | | 10/1966 | Reichenbach |
| 3,280,903 | A | | 10/1966 | Stoddard |
| 3,306,035 | A | | 2/1967 | Morrell |
| 3,354,873 | A | | 11/1967 | Burnell |
| 3,476,094 | A | * | 11/1969 | Guernsey et al. ..... 123/406.69 |
| 3,659,499 | A | | 5/1972 | Woodward |
| 3,666,057 | A | | 5/1972 | Leifer et al. |
| 3,760,785 | A | | 9/1973 | Harrison et al. |
| 3,786,869 | A | | 1/1974 | McLoughlin |
| 3,847,131 | A | | 11/1974 | Hisatomi |
| 3,881,685 | A | | 5/1975 | Hase et al. |
| 3,937,302 | A | | 2/1976 | Palmcrantz |
| 3,971,356 | A | | 7/1976 | Schlage |
| 3,982,397 | A | | 9/1976 | Laurent |
| 3,983,697 | A | | 10/1976 | Goto et al. |
| 3,997,019 | A | | 12/1976 | Inoue |
| 4,022,179 | A | | 5/1977 | Kalert et al. |
| 4,083,338 | A | | 4/1978 | Bertling et al. |
| 4,084,373 | A | | 4/1978 | Hashimoto et al. |
| 4,094,284 | A | * | 6/1978 | Gesell ..... 123/444 |
| 4,103,652 | A | | 8/1978 | Garside et al. |
| 4,117,640 | A | | 10/1978 | Vanderstar |
| 4,139,332 | A | | 2/1979 | Cantrell et al. |
| 4,154,058 | A | | 5/1979 | Mase et al. |
| 4,165,611 | A | | 8/1979 | Ishikawa |
| 4,176,642 | A | | 12/1979 | Shipinski |
| 4,290,399 | A | | 9/1981 | Takada et al. |
| 4,304,202 | A | | 12/1981 | Schofield |
| 4,342,299 | A | | 8/1982 | Haka |
| 4,355,611 | A | | 10/1982 | Hasegawa |
| 4,368,704 | A | | 1/1983 | Masaki |
| 4,370,960 | A | | 2/1983 | Otsuka |
| 4,383,510 | A | | 5/1983 | Nakamura et al. |
| 4,387,565 | A | | 6/1983 | Otani et al. |
| 4,391,246 | A | | 7/1983 | Kawabata et al. |
| 4,395,876 | A | | 8/1983 | Marsee et al. |
| 4,425,888 | A | | 1/1984 | Engel et al. |
| 4,437,306 | A | | 3/1984 | Ikenoya et al. |
| 4,450,932 | A | | 5/1984 | Khosropour et al. |
| 4,502,436 | A | | 3/1985 | Bonfiglioli et al. |
| 4,510,903 | A | | 4/1985 | Sakakiyama |
| 4,526,060 | A | | 7/1985 | Watanabe |
| 4,530,334 | A | | 7/1985 | Pagdin |
| 4,546,744 | A | | 10/1985 | Bonfiglioli |
| 4,549,400 | A | | 10/1985 | King |
| 4,559,185 | A | | 12/1985 | Seto et al. |
| 4,567,870 | A | | 2/1986 | Tumber |
| 4,640,245 | A | | 2/1987 | Matsuda et al. |
| 4,660,518 | A | | 4/1987 | Tamaki |
| 4,709,675 | A | | 12/1987 | Fujita |
| 4,773,369 | A | | 9/1988 | Kobayashi et al. |
| 4,793,309 | A | | 12/1988 | Huffman et al. |
| 4,836,164 | A | | 6/1989 | Morozumi et al. |
| 4,836,167 | A | | 6/1989 | Huffman et al. |
| 4,884,541 | A | | 12/1989 | Marriott |
| 4,941,443 | A | | 7/1990 | Yamaguchi et al. |
| 4,944,267 | A | | 7/1990 | Mann |
| 4,969,435 | A | | 11/1990 | Morikawa et al. |
| 4,977,879 | A | | 12/1990 | Schmidt et al. |
| 5,003,949 | A | | 4/1991 | Fanner et al. |
| 5,035,580 | A | | 7/1991 | Simonette |
| 5,060,744 | A | | 10/1991 | Katoh et al. |
| 5,069,180 | A | | 12/1991 | Schmidt et al. |
| 5,146,889 | A | | 9/1992 | Swanson et al. |
| 5,186,142 | A | | 2/1993 | Brunelli et al. |
| 5,208,519 | A | | 5/1993 | Dykstra et al. |
| 5,235,804 | A | | 8/1993 | Colket, III et al. |
| 5,235,943 | A | | 8/1993 | Fiorenza, II |
| 5,293,854 | A | | 3/1994 | Tracy et al. |
| 5,345,763 | A | | 9/1994 | Sato |
| 5,351,529 | A | | 10/1994 | Locke, Sr. |
| 5,431,013 | A | | 7/1995 | Yamaki et al. |
| 5,459,664 | A | | 10/1995 | Buckalew |
| 5,459,998 | A | | 10/1995 | Hosoya et al. |
| 5,479,908 | A | | 1/1996 | Grinberg et al. |
| 5,503,125 | A | | 4/1996 | Gund |
| 5,526,786 | A | | 6/1996 | Beck et al. |
| 5,595,531 | A | | 1/1997 | Niemela et al. |
| 5,642,711 | A | | 7/1997 | Boner et al. |
| D382,853 | S | | 8/1997 | Crawford |
| 5,666,804 | A | | 9/1997 | Sekiya et al. |
| 5,680,024 | A | | 10/1997 | Ehle et al. |
| 5,720,906 | A | | 2/1998 | Yamanaka et al. |
| 5,726,503 | A | | 3/1998 | Domanski et al. |
| 5,810,560 | A | | 9/1998 | Tanaka |
| 5,902,971 | A | | 5/1999 | Sato et al. |
| 6,021,370 | A | | 2/2000 | Bellinger et al. |
| 6,092,793 | A | | 7/2000 | Yanagii |
| 6,113,193 | A | | 9/2000 | Kunzeman |
| 6,216,453 | B1 | | 4/2001 | Maurer |
| 6,276,449 | B1 | | 8/2001 | Newman |
| 6,365,982 | B1 | | 4/2002 | Iles et al. |
| 6,971,369 | B1 | | 12/2005 | Mitchell et al. |
| 6,983,736 | B2 | | 1/2006 | Mitchell et al. |
| 7,373,921 | B2 | | 5/2008 | Geyer et al. |
| 2002/0053339 | A1 | | 5/2002 | Bootle et al. |
| 2003/0037749 | A1 | | 2/2003 | Imafuku et al. |
| 2004/0112333 | A1 | | 6/2004 | Mitchell et al. |
| 2006/0054381 | A1 | | 3/2006 | Takemoto et al. |
| 2007/0079604 | A1 | | 4/2007 | Macaluso |
| 2007/0240404 | A1 | | 10/2007 | Pekrul et al. |
| 2008/0014096 | A1 | | 1/2008 | Gilpatrick |
| 2011/0005024 | A1 | | 1/2011 | Spitler et al. |
| 2011/0214641 | A1 | | 9/2011 | Vaughn et al. |

OTHER PUBLICATIONS

Honda; V-Twin Series Engines, © 2009, American Honda Motor Co., Inc., 11 pages.

Honda; V-Twin Engines, © 2002, American Honda Motor Co., Inc., 10 pages.

Honda Power Equipment; printed from website http://www.hondapowerequipment.com/products/generators/content.aspx on Mar. 15, 2010, 5 pages.

Partial International Search Report regarding International Application No. PCT/US2013/043758, dated Aug. 2, 2013, 2 pages.

International Search Report and Written Opinion for International Application No. PCT/US2013/043758, dated Sep. 24, 2013, 16 pages.

* cited by examiner

ENGINE SPEED CONTROL SYSTEM

BACKGROUND

The present invention relates generally to the field of engines. More specifically the present invention relates to systems for controlling the speed of engines.

An engine governor is used to help regulate engine speed, which is typically quantified in terms of the revolutions per minute (rpm) of the engine output shaft (e.g., crankshaft). The governor systems operate in one of three configurations: the governor is pneumatically controlled by the air cooling system of the engine, the governor is mechanically controlled by the crankshaft, or the governor senses a rate of electrical pulses of an ignition system of the engine. In each configuration, the engine speed is communicated to a portion of the engine that regulates fuel usage (e.g., throttle assembly), where if the engine is running too slow, fuel flow through the engine is increased, increasing the engine speed—and vice versa.

Typical engine governors experience a phenomenon called "droop," where a decrease in the engine speed occurs with an increase in loading of the engine. As a result of droop, an engine that is running without load operates at a higher speed than a fully loaded engine. By way of example, such a difference in engine speed may range from about 250 to 500 rpm between an unloaded and fully loaded engine. For example, the engine for a pressure washer may run at about 3750 rpm with no load, and at about 3400 rpm at full load.

SUMMARY

One embodiment of the invention relates to an engine, which includes a throttle assembly, a governor, and an actuator. The throttle assembly is designed to at least partially control a fuel flow rate of the engine. The governor is designed to sense a speed of the engine and at least partially control the throttle assembly as a function of the engine speed. The actuator is designed to sense a manifold vacuum pressure of the engine and at least partially control the throttle assembly as a function of the vacuum pressure.

Another embodiment of the invention relates to a control system for controlling the speed of an engine. The control system includes a throttle, an actuator, and a mechanical linkage. The throttle assembly is designed to at least partially control a fuel flow rate of the engine. The actuator is designed to sense a manifold vacuum pressure of the engine. The mechanical linkage is designed to communicate between the actuator and the throttle assembly such that the actuator at least partially controls the throttle assembly as a function of the vacuum pressure of the engine.

Yet another embodiment of the invention relates to power equipment including a work implement and an engine for driving the work implement. The engine includes a throttle assembly, an actuator, and a linkage. The throttle assembly is designed to at least partially control a fuel flow rate of the engine. The actuator is designed to sense a vacuum pressure of the engine. The linkage is designed to communicate between the actuator and the throttle assembly such that the actuator at least partially controls the throttle assembly as a function of the vacuum pressure of the engine.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
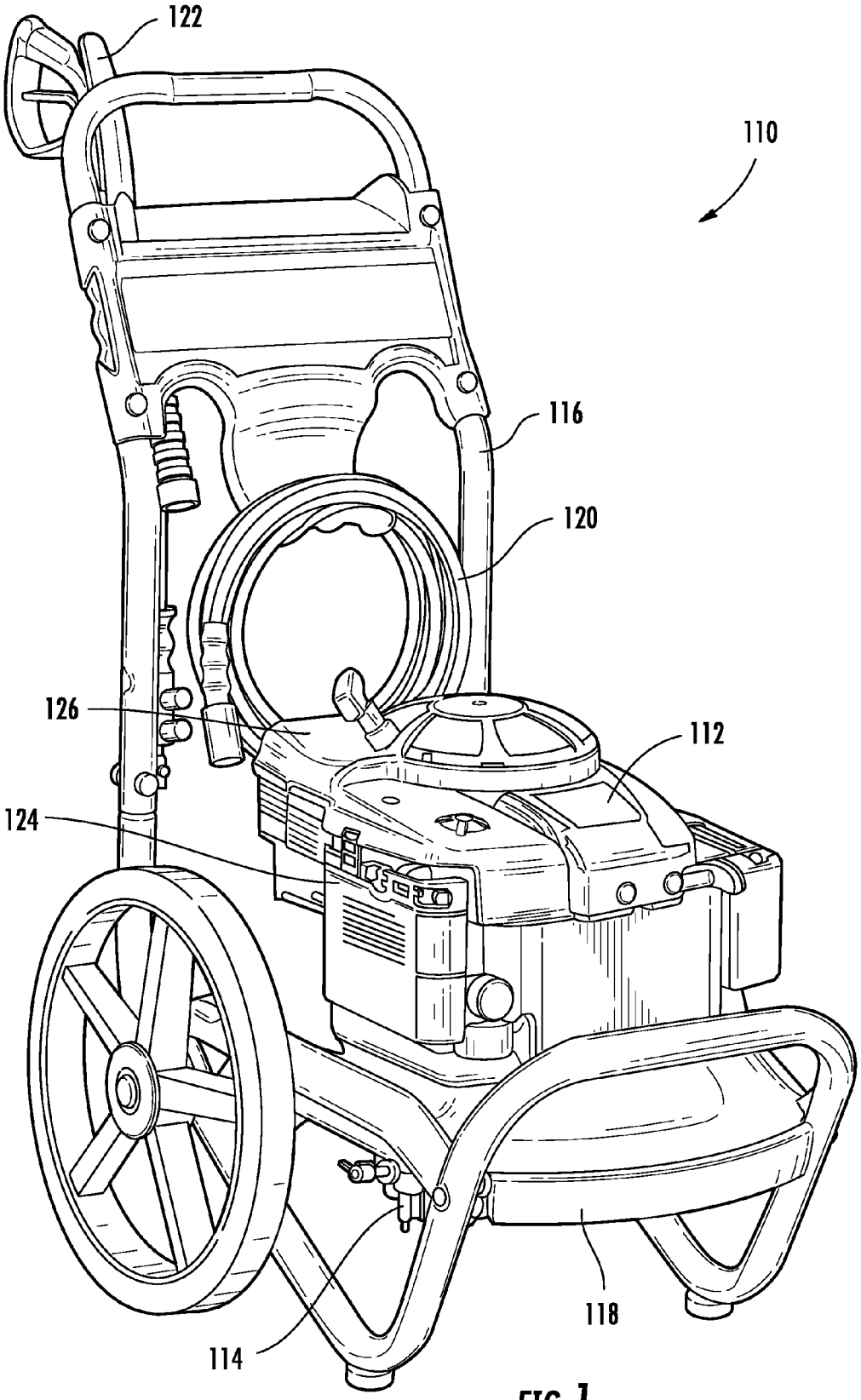
FIG. 1 is a perspective view of a pressure washer system according to an exemplary embodiment of the invention.

Referring to FIG. 1, power equipment in the form of a pressure washer 110 includes an engine 112 for driving a work implement in the form of a water pump 114 (e.g., triplex pump, axial cam pump, centrifugal pump). The engine 112 is supported by a frame 116 of the pressure washer 110, which includes a base plate 118 to which the engine 112 is fastened. Below the engine 112, the water pump 114 is also fastened to the base plate 118. A hose (not shown), such as a garden hose coupled to a faucet or other water source, may be used to supply water to an inlet of the water pump 114, which then pressurizes the water. A high pressure hose 120 may be connected to an outlet of the water pump 114, for receiving the pressurized water and delivering the water to a sprayer, such as a pressure washer spray gun 122.

Loading of the engine 112 of the pressure washer 110 varies as a function of whether the water pump 114 is actively pressurizing the water, is in a recirculation mode because the spray gun 122 is inactive, or is decoupled for the engine 112 (e.g., via an intermediate clutch). Further, the degree of loading of the engine 112 may vary with respect to which particular setting or nozzle is used by the spray gun 122 (e.g., high-pressure nozzle, high-flow-rate setting, etc.).

While the engine 112 is shown as a single-cylinder, four-stroke cycle, internal-combustion engine; in other contemplated embodiments diesel engines, two-cylinder engines, and electric motors may be used to drive work implements, such as a lawn mower blade, a drive train of a tractor, an alternator (e.g., generator), a rotary tiller, an auger for a snow thrower, or other work implements for various types of power equipment. In some embodiments, the engine 112 is vertically shafted, while in other embodiments an engine is horizontally shafted.

Figure 2:
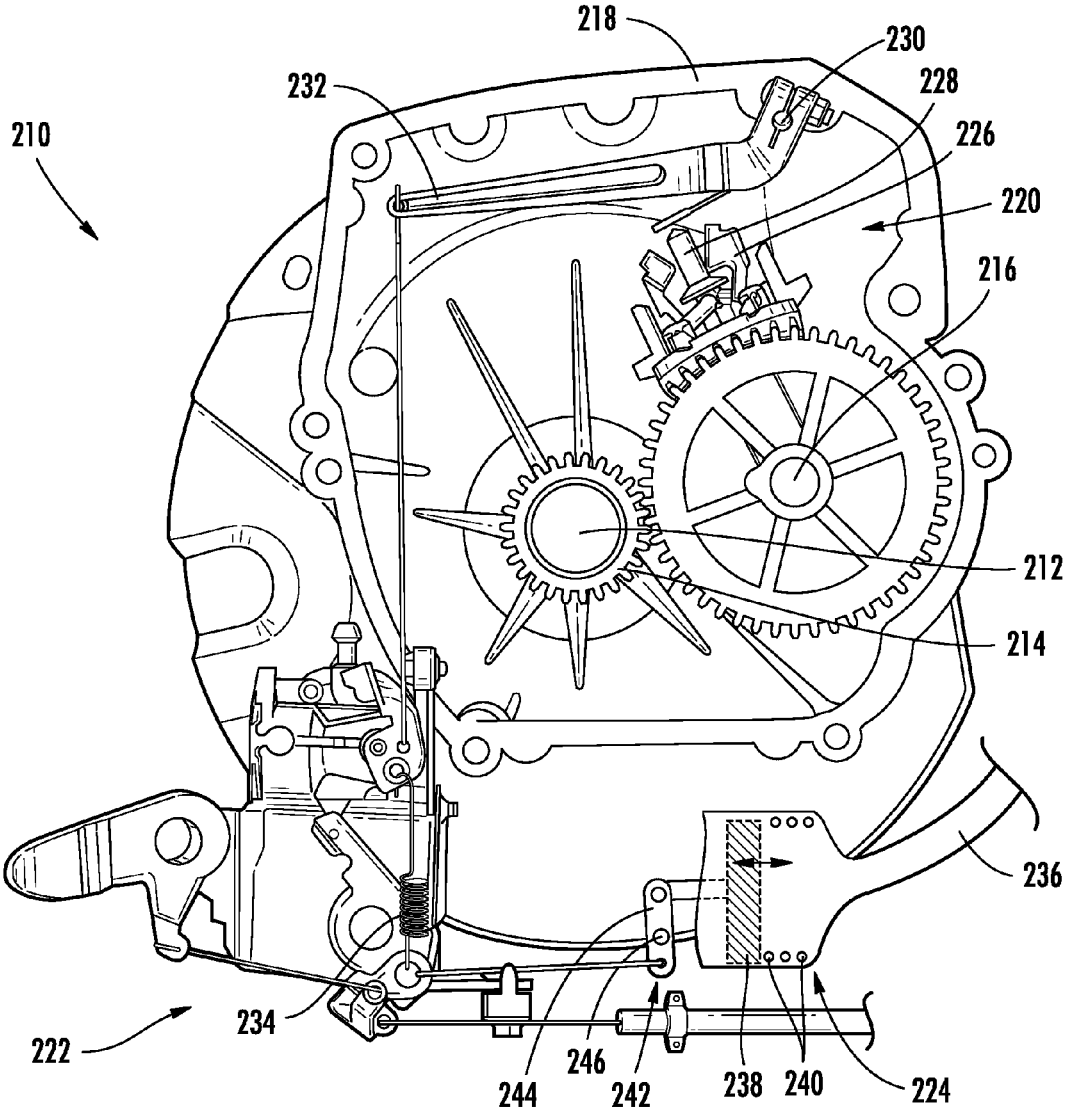
FIG. 2 is a sectional view an engine according to an exemplary embodiment of the invention.

Referring to FIG. 2, an engine 210 may be used to drive a pressure washer pump, or to drive a work implement for another form of power equipment. The engine 210 includes a crankshaft 212 having a timing gear 214, and a camshaft 216 rotationally coupled to the crankshaft 212 by way of the timing gear 214. The crankshaft 212 and camshaft 216 are both generally positioned within a crankcase 218 of the engine 210. A governor system 220 (e.g., mechanical governor) is coupled to the camshaft 216 and to the crankshaft 212, by way of the camshaft 216.

The governor system 220 is also coupled (e.g., mechanically linked) to a throttle assembly 222, and communicates the speed of the engine 210 to the throttle assembly 222. The engine 210 further includes an actuator 224 (e.g., supplementary governor, load-based governor input) coupled to the throttle assembly 222 that communicates the load (e.g., load level, loading, torque, etc.) experienced by the engine to the throttle assembly 222.

Figure 4:
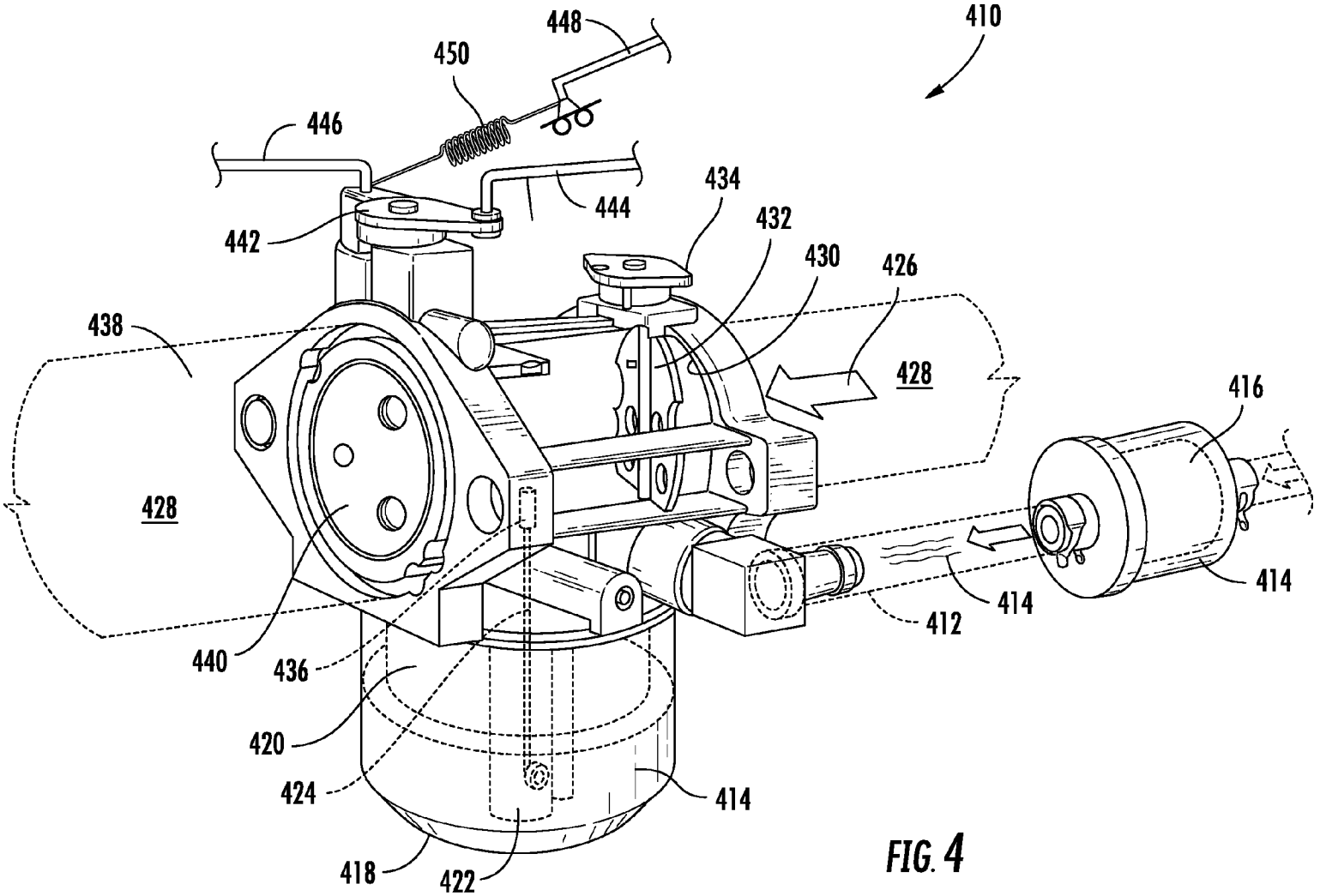
FIG. 4 is a perspective view of a carburetor system according to an exemplary embodiment of the invention.

According to an exemplary embodiment, the governor system 220 includes flyweights 226 coupled to the crankshaft 212 by way of the camshaft 216, and a governor cup 228 driven by movement of the flyweights 226. As the crankshaft 212 rotates faster, the flyweights 226 move outward, driving the governor cup 228 upward (e.g., forward, outward), and vice versa. A governor shaft 230 and/or governor arm 232 (e.g., throttle linkage) transfers movement of the governor cup 228 to a governor spring 234, used to bias a throttle plate (see, e.g., throttle plate 440 as shown in FIG. 4) of the throttle assembly 222. The throttle plate controls an opening (see, e.g., throat 430 of carburetor 410 as shown in FIG. 4) through which air and fuel is supplied to a combustion chamber (not shown) of the engine 210. As such, the governor system 220 at least partially controls the rate of fuel flowing through the engine 210, by manipulating the throttle assembly 222.

The actuator 224 is coupled to an interior portion of the engine 210 (e.g., intake manifold, interior of crankcase 218) via a conduit 236, which links (e.g., in fluid communication) the actuator 224 with the vacuum pressure of the engine 210 (e.g., ported pressure, manifold pressure). The vacuum pressure fluctuates as a function of engine load, such that engine vacuum decreases when loading of the engine 210 increases, and vice versa. The actuator 224 converts changes in the engine vacuum into a signal, which is then communicated to the throttle assembly 222.

According to the exemplary embodiment of FIG. 2, engine vacuum fluctuations are sensed by a plunger 238 (e.g. piston) within the actuator 224. The plunger 238 is biased by a spring 240, and moves a linkage 242 (e.g., mechanical linkage, such as a network of arms and levers, a pulley system, a Bowden cable, etc.; electrical linkage, such as a sensor coupled to a solenoid by wire). In some embodiments, the linkage 242 includes a member 244 that rotates about a fulcrum 246 (e.g., pivot point), converting forward motion on one end of the member 244 to rearward motion on an opposite end of the member 244.

The linkage 242 communicates movement of the plunger 238 to the throttle assembly 222, such as by loading the governor spring 234 (in addition to loads provided by the governor system 220), which is coupled to the throttle plate. The actuator 224 at least partially controls the rate of fuel flowing through the engine 210 by manipulating the throttle assembly 222. In other embodiments, the linkage 242 may be coupled to another plate (see, e.g., choke plate 432 as shown in FIG. 4), spring, or other fuel-flow controller, other than the governor spring 234 and throttle plate.

According to an exemplary embodiment, when engine vacuum pressure is low (e.g., such as with a heavy engine load), the actuator 224 increases force in the governor spring 234 of the throttle assembly 222, opening the throttle plate. Conversely, when engine vacuum is high, the actuator 224 reduces governor spring force. Accordingly, the engine 210 speeds up when increased load is present, and slows down when the load is removed, the control system of which may be referred to as a negative governor droop configuration or an on-demand governor system. The engine 210 increases engine speed with load and decreases speed with absence of load, which provides the user with an 'idle down' feature. In some embodiments, the engine 210 runs at about 2600 rpm without loading and about 3500 rpm (e.g., 3400-3700 rpm) at full load. The engine 210 of FIG. 2 is intended to run quieter at light engine loads, use less fuel at light to moderate engine loads, receive less engine wear, receive extended application life (e.g., extended water pump life), and produce greater useable power at full load.

Figure 3:
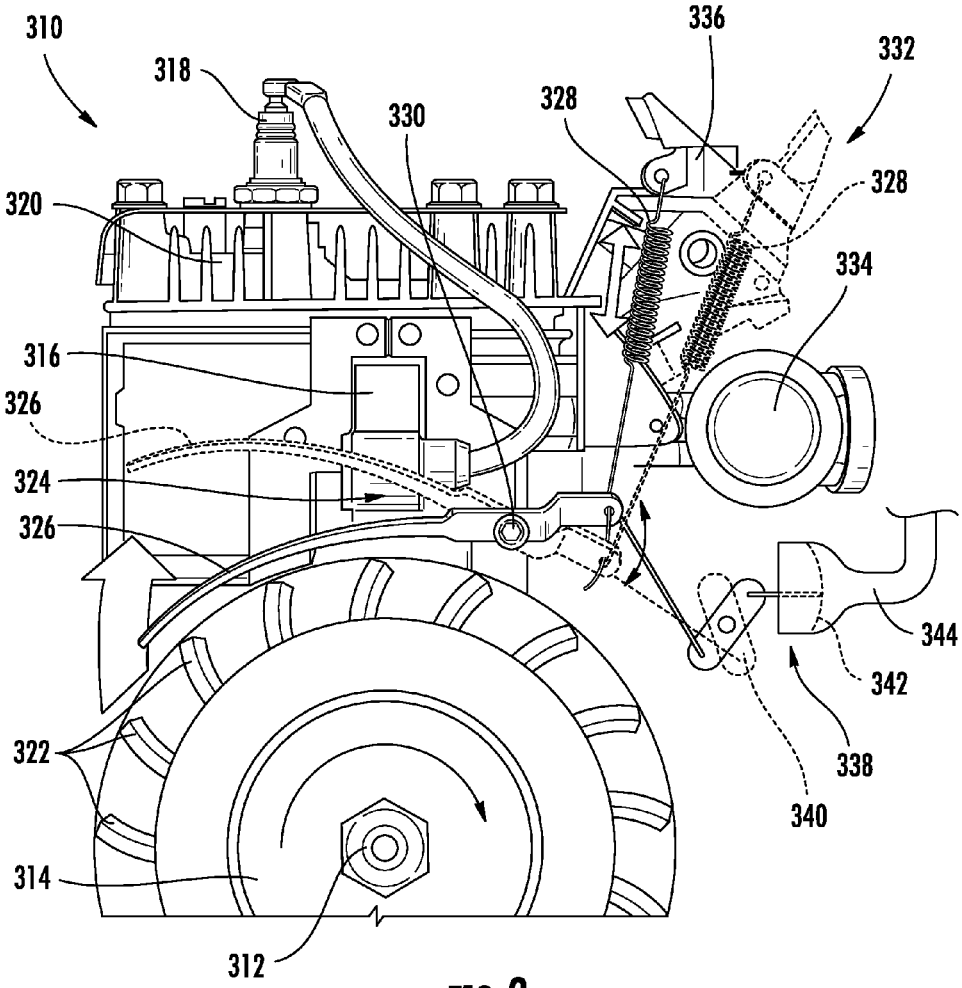
FIG. 3 is a sectional view an engine according to another exemplary embodiment.

Referring to FIG. 3, an engine 310 includes a crankshaft 312 with a flywheel 314 mounted to the crankshaft 312. Proximate to the flywheel 314, the engine includes an ignition system 316, which uses magnets (not shown) coupled to the flywheel 314 to generate timed sparks from a sparkplug 318, which extend through a cylinder head 320 of the engine 310, into a combustion chamber (not shown). The flywheel 314 includes fan blades 322 extending therefrom, which rotate with the crankshaft 312 and serve as a blower for air cooling the engine 310. The intensity of the blower is proportional to the rotational speed of the crankshaft 312.

The engine 310 further includes a pneumatic governor system 324, which includes an air vane 326 coupled to a governor spring 328. As the speed of the engine 310 increases, air from the fan blades 322 pushes the air vane 326, which rotates about a fulcrum 330 (e.g., pivot point). On the far side of the fulcrum 330, the air vane 326 is coupled to the governor spring 328, which is loaded by the movement of the air vane 326. Tension in the governor spring 328 biases the air vane 326, influencing movement of the throttle plate (see, e.g., throttle plate 440 as shown in FIG. 4) of a throttle assembly 332 toward a closed position, decreasing air and fuel flowing through a carburetor 334 to the combustion chamber of the engine 310, and thus reducing the engine speed. The governor spring 328 is further coupled to a throttle lever 336, which can be manually moved to alter tension in the governor spring 328.

Still referring to FIG. 3, the engine 310 also includes an actuator 338 that is coupled to the throttle assembly 332 by way of a linkage 340. The actuator 338 includes a diaphragm 342 that is positioned between air under engine vacuum pressure and air under atmospheric pressure. The vacuum side of the actuator 338 is not in fluid communication with atmospheric air. In some embodiments, one side of the diaphragm 342 is coupled to an intake manifold (e.g., conduit of air from the carburetor to the combustion chamber) of the engine via a conduit 344. The linkage 340 receives movement of the diaphragm 342 and communicates the movement to the throttle assembly 332 by loading (e.g., tensioning, relaxing) the governor spring 328. As such the actuator 338 at least partially controls the rate of air/fuel flowing through the carburetor, by manipulating the throttle assembly 332.

Referring to FIG. 4, an engine (see, e.g., engines 112, 210, 310 as shown in FIGS. 1-3) may use a carburetor 410 to introduce fuel 414 into air 426 flowing from an air intake (see, e.g., intake 124 as shown in FIG. 1) to a combustion chamber of the engine. A fuel line 412 supplies the fuel 414 (e.g., gasoline, ethanol, diesel, alcohol, etc.) from a fuel tank (see, e.g., fuel tank 126 as shown in FIG. 1), through a fuel filter 416, and to a float bowl 418 of the carburetor 410. The fuel level (e.g., quantity) in the float bowl 418 is regulated by a float 420 coupled to a valve (not shown) along (e.g., in series with) the fuel line 412.

Fuel 414 is delivered from the float bowl 418 up through a pedestal 422 along a main jet 424 of the carburetor 410. Simultaneously, air 426 passes from the air intake to a throat 430 of the carburetor 410. Air passes into the carburetor 410, past a choke plate 432. A choke lever 434 may be used to turn the choke plate 432 so as to block or to allow the air 426 to flow into the carburetor 410. The air 426 passes through the throat 430 with a positive velocity, and passes the main jet 424 at a lower pressure than the air of the float bowl 418 (under atmospheric air pressure). As such the fuel 414 is delivered through the main jet 424 and into the air 426 passing through a nozzle 436 (e.g., venturi) in the carburetor 410.

The fuel and air mixture 438 then flows out of the carburetor 410. However, the fuel and air mixture 438 passes a throttle plate 440 as the fuel and air mixture 438 is flowing out of the carburetor 410. When the throttle plate 440 is fully open (i.e., turned so as to minimally interfere with the fuel and air mixture 438), a maximum amount of the fuel and air mixture 438 is allowed to pass to the combustion chamber. However, as the throttle plate 440 is turned (e.g., closed) so as to impede the fuel and air mixture 438, a lesser amount of the fuel and air mixture 438 is allowed to pass to the combustion chamber. Operation of the throttle plate 440 is controlled by a throttle lever 442.

Figure 7:
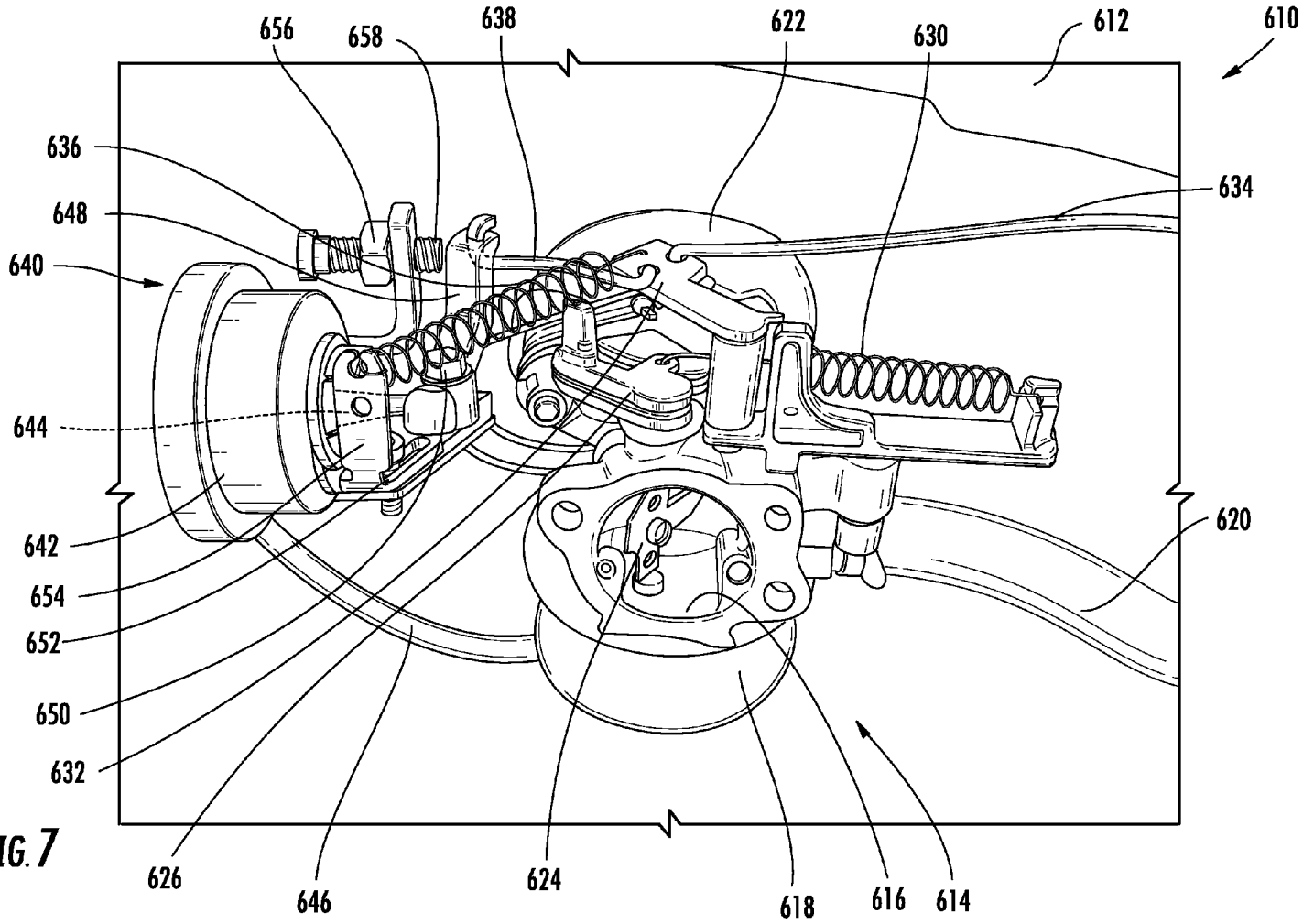
FIG. 7 is a perspective view of a portion of an engine according to yet another exemplary embodiment of the invention.

According to an exemplary embodiment, the throttle lever 442 is at least partially controlled by a first linkage 444 coupled to a governor system (see, e.g., governor system 220 as shown in FIG. 2), which loads the throttle lever 442 as a function of the speed of the engine. The throttle lever 442 is further at least partially controlled by a second linkage 446 coupled to an actuator (see, e.g., actuator 640 as shown in FIG. 7), which loads the throttle lever 442 as a function of the load level of the engine. The throttle lever 442 is still further at least partially controlled by a third linkage 448 coupled to a manual throttle control lever (see, e.g., throttle lever 336 as shown in FIG. 3), which adjusts tension in a governor spring 450 coupled to the throttle lever 442. During some uses of the engine, it is contemplated that one or more of the linkages 444, 446, 448 may apply little or no force to the throttle lever 442, while one or more others of the linkages 444, 446, 448 substantially control movement of the throttle lever 442, and therefore the movement of the throttle plate 440. In other embodiments, the relative positions of the linkages 444, 446, 448 and the governor spring 450 may be otherwise arranged in relation to the throttle lever 442.

While embodiments shown in the figures show engines incorporating carburetors for controlling the insertion of fuel into air that is delivered to the engine for combustion purposes, in other contemplated embodiments, commercially-available fuel injection systems may be used in place or in conjunction with carburetors. In such embodiments, the rate of fuel injected may be at least partially controlled by a governor as a function of engine speed, and at least partially controlled by an actuator that is sensitive to engine vacuum pressure.

Figure 5:
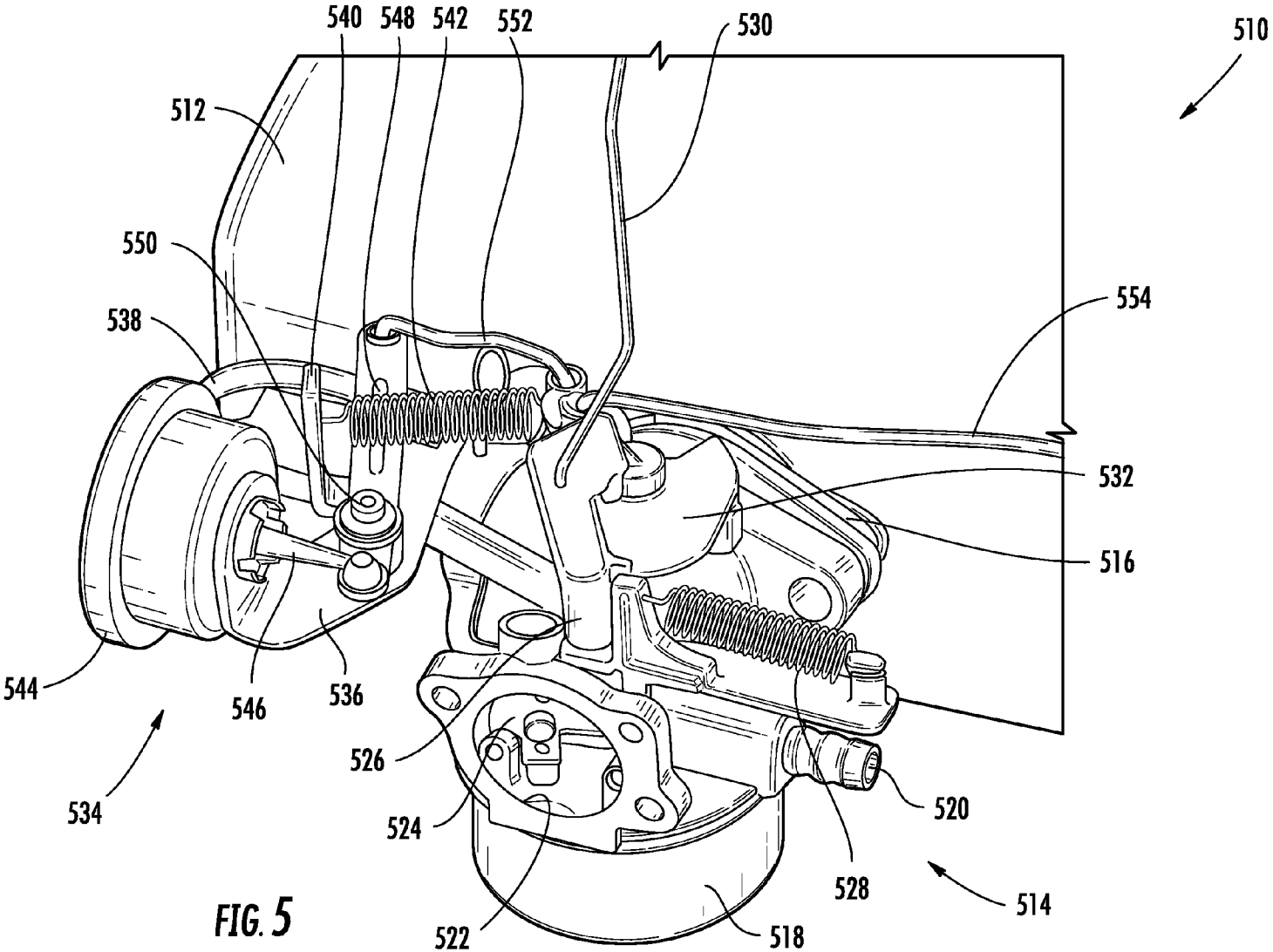
FIG. 5 is a perspective view of a portion of an engine according to an exemplary embodiment of the invention.

Referring now to FIG. 5, an engine 510 includes a crankcase 512, a carburetor 514, and an intake manifold 516 directing air and fuel into a combustion chamber (not shown) within the crankcase 512. The carburetor 514 includes a float bowl 518, a fuel line 520, and a throat 522 through which air flows to receive fuel from a venturi nozzle (see, e.g., nozzle 436 as shown in FIG. 4). The carburetor 514 further includes a choke plate 524 coupled to a choke lever 526 for rotating the choke plate 524 relative to the throat 522. A choke spring 528 (e.g., ready-start choke spring) and a choke linkage 530 are each coupled to the choke lever 526, for manipulating the choke plate 524. The carburetor 514 still further includes a throttle plate (see, e.g., throttle plate 440 as shown in FIG. 4) coupled to a throttle lever 532 for rotating the throttle plate relative to the throat 522.

Figure 9:
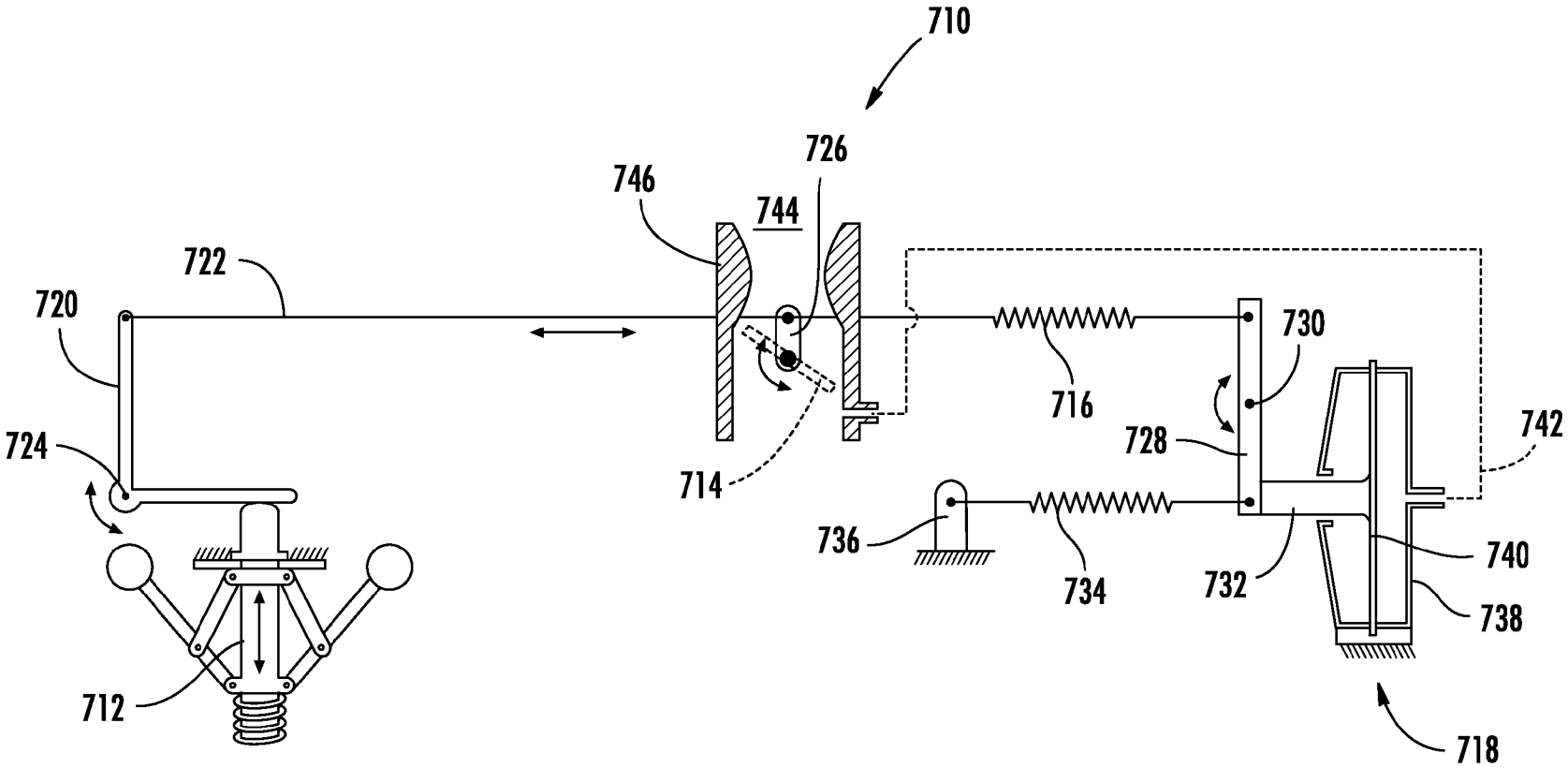
FIG. 9 is a schematic diagram of a control system according to an exemplary embodiment of the invention.

An actuator 534 is fastened to a bracket 536 and coupled to the intake manifold 516 of the engine 510 by way of a conduit 538 (e.g., rubber hose, metal piping). The bracket 536 additionally includes a tang 540 extending therefrom to which a governor spring 542 is coupled, which biases the throttle lever 532. The actuator 534 includes a housing 544 surrounding a pressure-sensitive member (see, e.g., diaphragm 740 as shown in FIG. 9, and plunger 238 as shown in FIG. 2) that moves a rod 546 in response to changes in engine vacuum. The rod 546 is connected to a pivot arm 548 that rotates about a fulcrum 550, and moves a linkage 552 (e.g., idle-down link) that is coupled to the throttle lever 532. A governor linkage 554 connects the throttle lever 532 to a governor system (see, e.g., governor system 220 as shown in FIG. 2) of the engine 510.

Increased loading on the engine 510 decreases the engine vacuum pressure in the intake manifold 516, which is relayed to the actuator 534 by way of the conduit 538. The actuator 534 moves the rod 546 in response to the change in engine vacuum, which rotates the pivot arm 548 about the fulcrum 550. Rotation of the pivot arm 548 is communicated to the throttle lever 532 by way of the linkage 552. Force applied by the linkage 552 on the throttle lever 532 is either enhanced, countered, or not affected by forces applied to the throttle lever 532 by the governor spring 542 and the governor linkage 554. The sum force (e.g., net force, cumulative force) on the throttle lever 532 rotates the throttle plate, which at least partially controls the flow of fuel and air through throat 522 of the carburetor 514 to adjust the engine speed.

Figure 6:
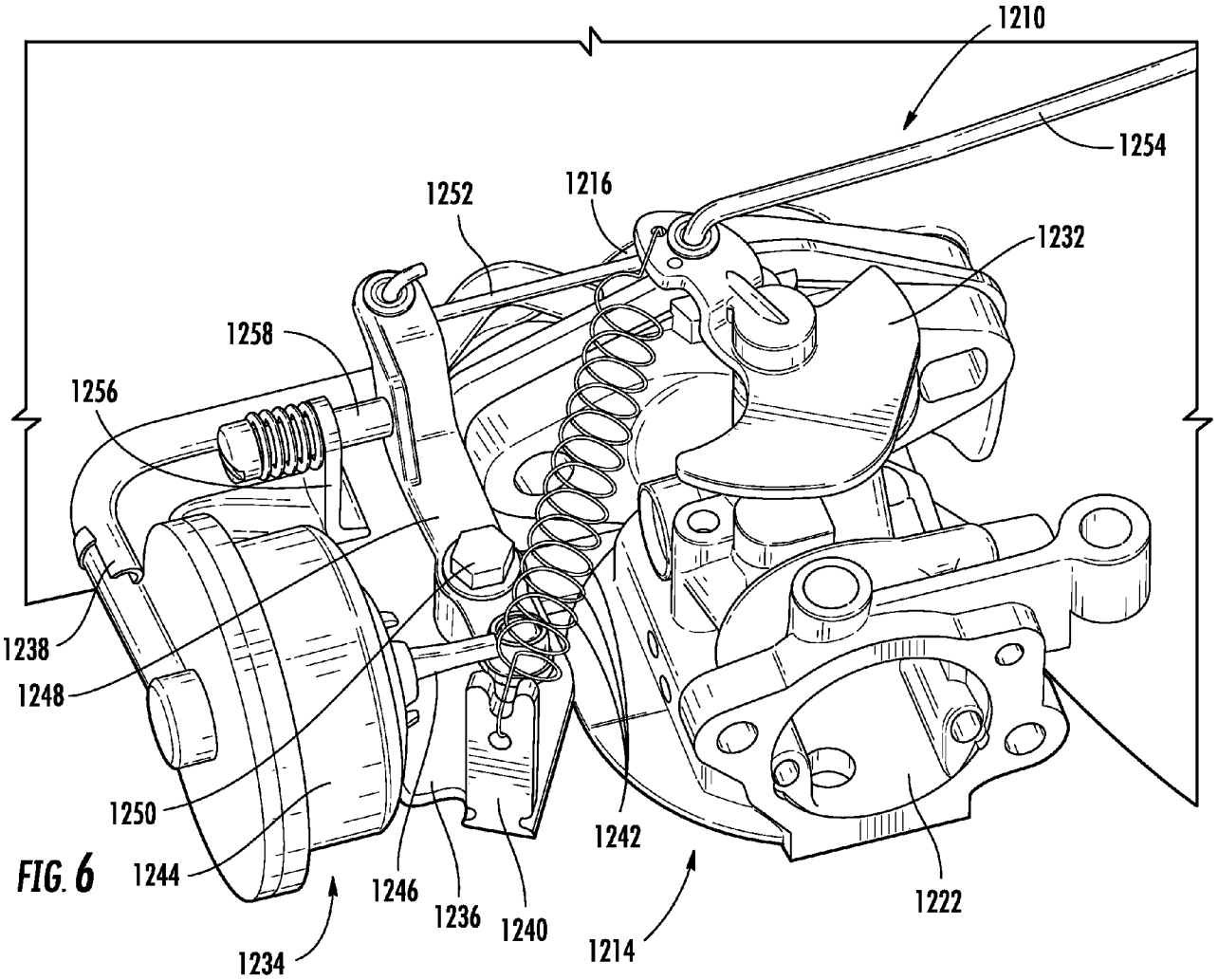
FIG. 6 is a perspective view of a portion of an engine according to another exemplary embodiment of the invention.

Referring to FIG. 6, a speed-control system 1210 for a combustion engine includes a carburetor 1214 and a pressure-sensitive actuator 1234. The actuator is coupled to an intake manifold 1216 or other portion of an engine, such that the actuator 1234 experiences pressure fluctuations of the engine that are produced as a function of load on the engine. According to an exemplary embodiment, a housing 1244 of the actuator 1234 is coupled to the intake manifold 1216 by way of a conduit 1238 (e.g., rubber hose). Pressure fluctuations are transferred from the actuator 1234 to a rod 1246 that moves a lever arm 1248 about a fulcrum 1250 to move a linkage 1252 coupled to a throttle lever 1232, controlling a flow rate of air through a throat 1222 of the carburetor 1214. Movement of the lever arm 1248 is limited by an adjustable backstop 1258. A governor linkage 1254 is also coupled to the throttle lever. A governor spring 1242 biases the throttle lever 1232, and extends to a tang 1240 of a bracket 1236 that supports the actuator 1234.

According to at least one embodiment, interaction between a pressure-sensitive actuator (see, e.g., actuator 1234 as shown in FIG. 6) and a throttle plate (see, e.g., throttle plate 440 as shown in FIG. 4) are directly related (e.g., proportional, linearly related) through a chain of connected components (e.g., gear train, mechanical linkage, etc.) such that any change in pressure sensed by the actuator is applied to the throttle plate to some degree, in combination with other forces acting on the throttle plate (e.g., governor spring, throttle linkage, etc.). For example, it is contemplated that such an embodiment may include damping (e.g., restrictors, dampers, etc.) that attenuates small pressure changes and noise, but that such an embodiment does not include slack or slop (e.g., excess degrees of freedom) in the chain of connected components that allows for movement of the actuator that is not at all relayed throttle plate, such as free movement of a lever arm or linkage within a bounded open space or slot. It is believed that such a direct relationship between actuator and throttle plate, when combined with controlled damping of noise, improves responsiveness of the throttle system (and also engine efficiency), saving fuel and extending life of engine components.

Figure 8:
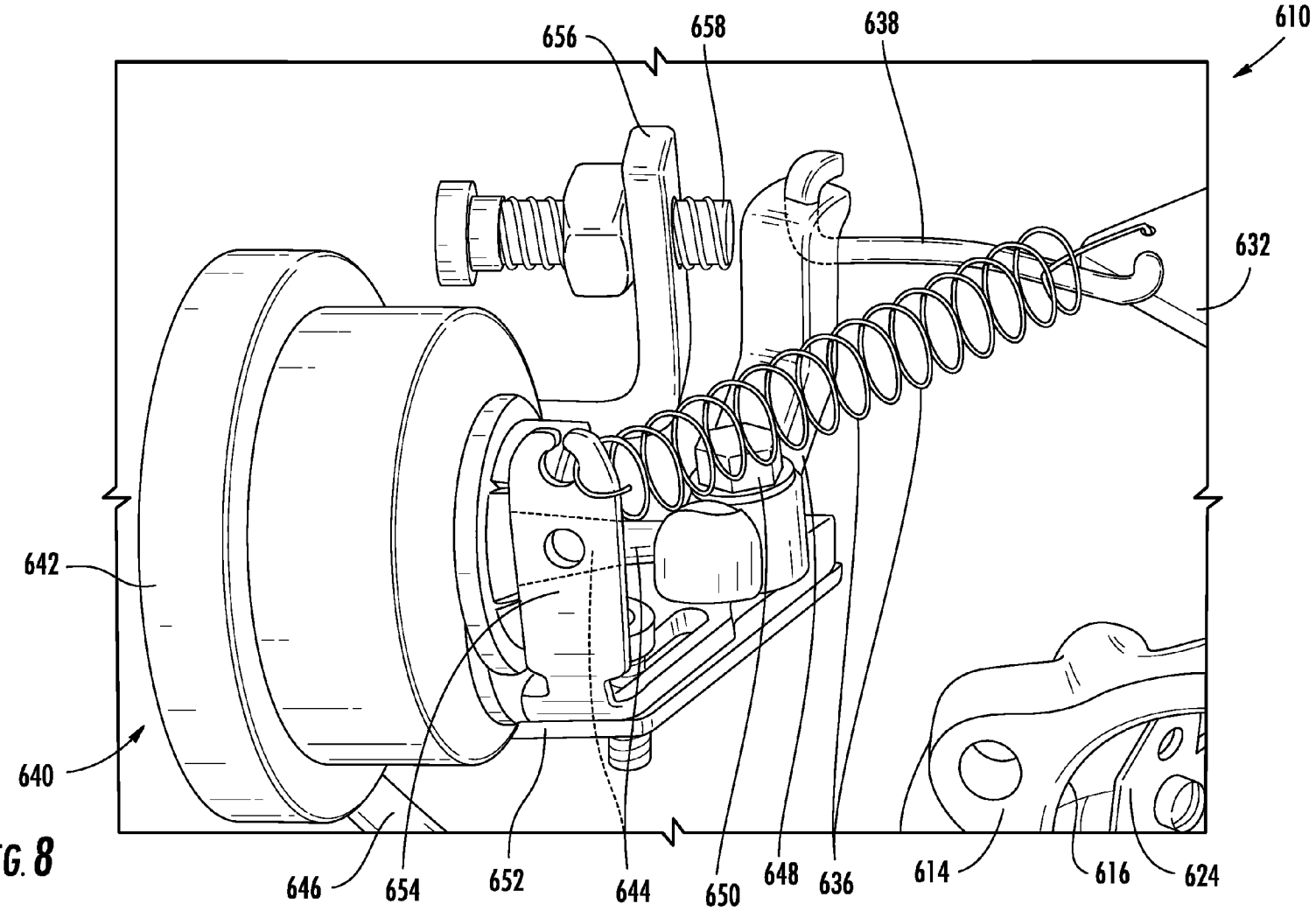
FIG. 8 is an enlarged view of the engine of FIG. 7.

Referring to FIGS. 7-8, an engine 610 may be used to drive power equipment, such as a riding lawn mower 612. The engine 610 includes a carburetor 614 having a throat 616 and a float bowl 618. A fuel line 620 directs fuel to the float bowl 618 of the carburetor 614 from a fuel tank (see, e.g., fuel tank 126 as shown in FIG. 1). The throat 616 is coupled to (integral with, adjacent to, etc.) an intake manifold 622 of the engine 610. The carburetor 614 further includes a choke plate 624 joined to a choke lever 626, which is at least partially controlled by both a choke linkage and/or a choke spring 630. The carburetor 614 still further includes a throttle plate (see, e.g., throttle plate 440 as shown in FIG. 4), which may be used to control the flow of fuel and air through the carburetor 614. The throttle plate is joined to a throttle lever 632, which is at least partially controlled by a governor linkage 634, a governor spring 636, and a linkage 638 from an actuator 640.

The actuator 640 includes a housing 642 at least partially surrounding a pressure-sensitive member therein. The pressure-sensitive member drives a rod 644 as a function of engine vacuum pressure, which is sensed by the pressure sensitive member of the actuator 640 by way of a conduit 646 coupled to the housing 642. When vacuum pressure of the engine 610 changes, the rod 644 rotates a lever arm 648 about a fulcrum 650, which moves the linkage 638, applying force to the throttle plate. The force of the linkage 638 is either complemented or opposed by either or both of the governor spring 636 and the governor linkage 638. As such, the net force applied to the throttle lever 632 controls the orientation of the throttle plate in the carburetor 614, at least partially controlling the flow of fuel and air through the engine 610.

The actuator 640 is supported by a bracket 652 coupled to the engine 610, where the bracket 652 includes a tang 654 extending therefrom, which supports an end of the governor spring 636. The bracket 652 further includes an extension 656 (e.g., portion, piece coupled thereto, etc.) through which a backstop 658 (e.g., high-speed throttle stop) extends. The backstop 658 may be used to limit movement of the lever arm 648, thereby limiting the maximum amount of movement that the linkage 638 applies to the throttle lever 632. According to an exemplary embodiment, the backstop 658 is adjustable, such as by a threaded coupling with the extension 656 of the bracket 652. In other embodiments, other limiters or backstops may be added to the engine 610 to further or otherwise limit movement of the linkage 638.

While the linkage 638 provides communication between the actuator 640 and the throttle plate, it is contemplated that such an actuator may otherwise control the flow of air and fuel through the engine. In some contemplated embodiments, the actuator may be linked to a valve to control the rate of fuel flowing from through a main jet or venturi nozzle in the carburetor (see, e.g., carburetor 410 as shown in FIG. 4). In other contemplated embodiments, the actuator may be linked to an adjustable restrictor or damper to control the flow rate of air through the throat and/or portions of the intake manifold. In some other contemplated embodiments, the actuator may be coupled to a frictional damper, coupled to the rod 644, the lever arm 648, or other portions of the engine 610, between the manifold 622 and the throttle plate (or other fuel injector). In still other contemplated embodiments, mass or length may be added to (or removed from) the lever arm 648 to dampen movement thereof, such as via mass, moment, and/or inertia to oppose or mitigate the effect of vibratory noise.

Referring to FIG. 9, a control system 710 for controlling the speed of an engine includes a governor 712 coupled to a throttle plate 714, a governor spring 716 opposing movement of the governor 712, and an actuator 718 coupled to the throttle plate 714. According to an exemplary embodiment, the control system 710 further includes a governor arm 720 and a governor linkage 722. The governor 712 rotates the governor arm 720 about a fulcrum 724 as a function of a sensed change in engine speed, which pulls or pushes the governor linkage 722. The governor linkage 722 is coupled to a throttle lever 726 (and/or to a throttle shaft), and is opposed by the governor spring 716. As such, movement of the governor linkage 722 overcomes bias in the governor spring 716, rotating the throttle lever 726, and accordingly rotating the throttle plate 714 attached thereto.

Still referring to FIG. 9, the governor spring 716 is further coupled to a pivoting member 728 (e.g., lever) rotatable about a fulcrum 730, the position of which may be adjustable along the pivoting member 728 in some contemplated embodiments. Opposite the governor spring 716 on the pivoting member 728, the actuator 718 includes a rod 732 coupled to the pivoting member 728. According to an exemplary embodiment, movement of the rod 732 is opposed by a spring 734, the tension of which may be adjustable (e.g., able to be set) in some contemplated embodiments, such as by moving a bracket 736 to which the spring 734 is coupled.

The actuator 718 includes a housing 738 and a diaphragm 740 therein, or another pressure-sensitive member, which is coupled by way of a conduit 742 to an air flow 744, the coupling of which may be before, during, or after air travels through a carburetor 746 or other fuel injection system. Changes in engine vacuum pressure are sensed by the diaphragm 740, which moves the rod 732, which rotates the pivoting member 728, which adjusts tension in the governor spring 716, at least partially controlling movement of the throttle plate 714.

The particular relative positions of the governor linkage 722, the governor spring 716, the pivoting member 728, the rod 732, and/or other components of the control system 710 may be otherwise arranged in some embodiments. In still other embodiments, components of the control system 710 may be omitted, such as the pivoting member 728, depending upon the arrangement of the other components of the control system 710. In contemplated embodiments, the diaphragm (or other pressure-sensitive member) may be mounted directly to, adjacent to, or proximate to the intake manifold or crankcase of an engine. In such embodiments, changes in engine vacuum may be communicated to a governor spring 716 or other portion of a throttle assembly from the diaphragm by way of a Bowden cable or other linkage.

Figure 10:
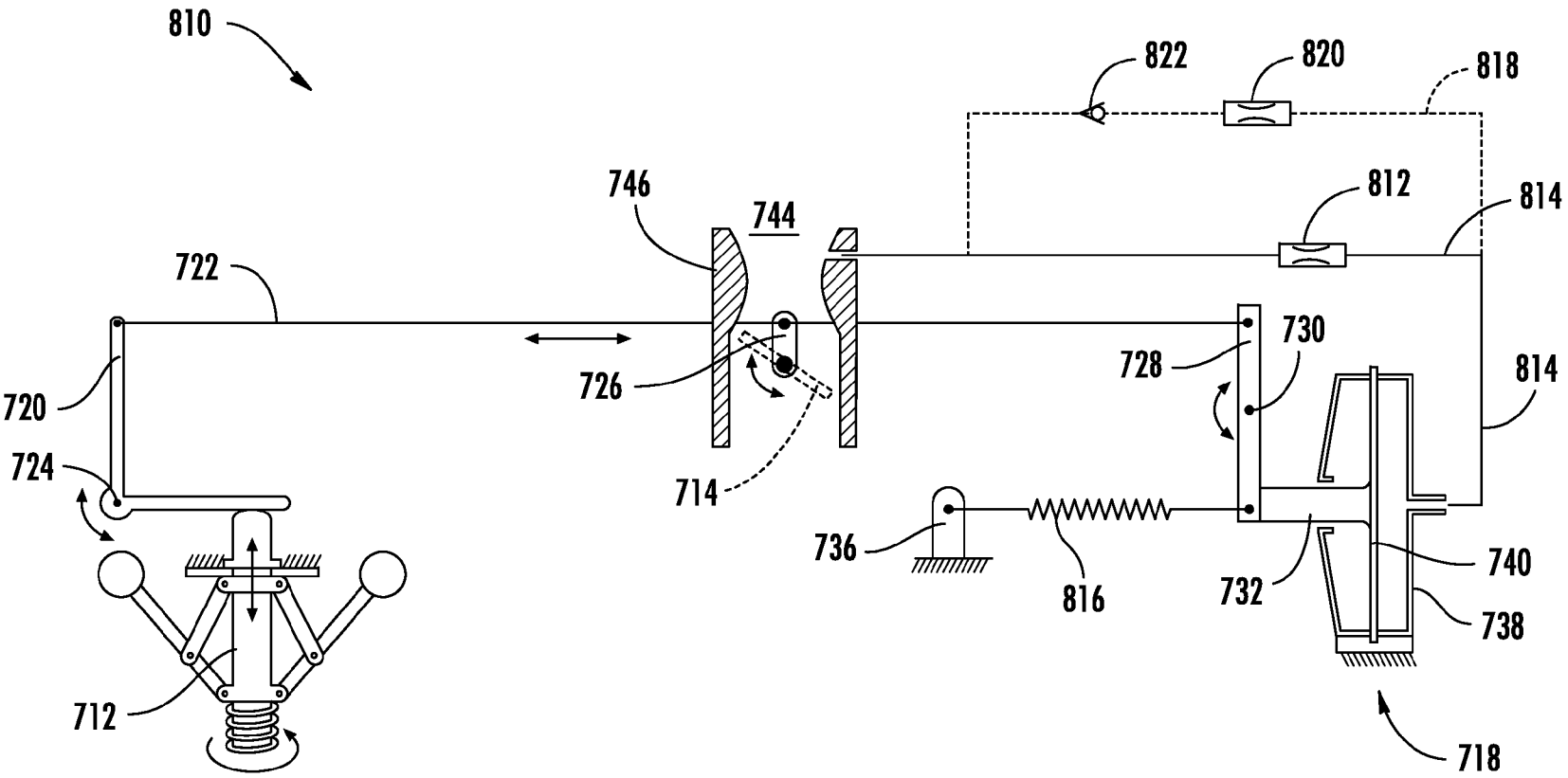
FIG. 10 is a schematic diagram of a control system according to another exemplary embodiment of the invention.

Referring to FIG. 10, a control system 810 for an engine including some components included in the control system 710, further includes a restrictor 812 (e.g., pneumatic damper, pneumatic valve) positioned along a first conduit 814 extending between the actuator 718 and the air flow 744. In some embodiments, the restrictor 812 is narrowed or higher-friction portion of the conduit 814 that is believed by the Applicants to dampen noise (e.g., temporally short fluctuations of pressure as a result of piston cycles) in engine vacuum that may not be related to the load level of the engine. The control system 810 includes a governor spring 816 positioned on the pivoting member 728, on the same side of the fulcrum 730 as the rod 732 of the actuator 718.

Still referring to FIG. 10, the control system 810, in some embodiments, further includes a second conduit 818 extending in parallel with the first conduit 814 (cf. in series with), between the actuator 718 and the air flow 744. The second conduit 818 includes a restrictor 820, which may produce a different magnitude of air flow restriction when compared to the restrictor 812 of the first conduit 814. In such embodiments, at least one check valve 822 is positioned in at least one of the first and second conduits 814, 818 such that air flow is directed through one of the restrictors 812, 820 when blocked from the other of the restrictors 812, 820 by the check valve 822. However, in other embodiments, one or both restrictors 812, 820 dampen pressure pulses, and do not require a device to bias the flow direction such as a check valve.

Use of separate first and second conduits 814, 818 arranged in parallel with each other, each having one of the restrictors 812, 820, and at least one check valve 822 positioned along one of the first and second conduits 814, 818, is intended to allow for independent control of overshoot- and undershoot-type responses of the control system 810 to changes in engine vacuum.

Figure 11:
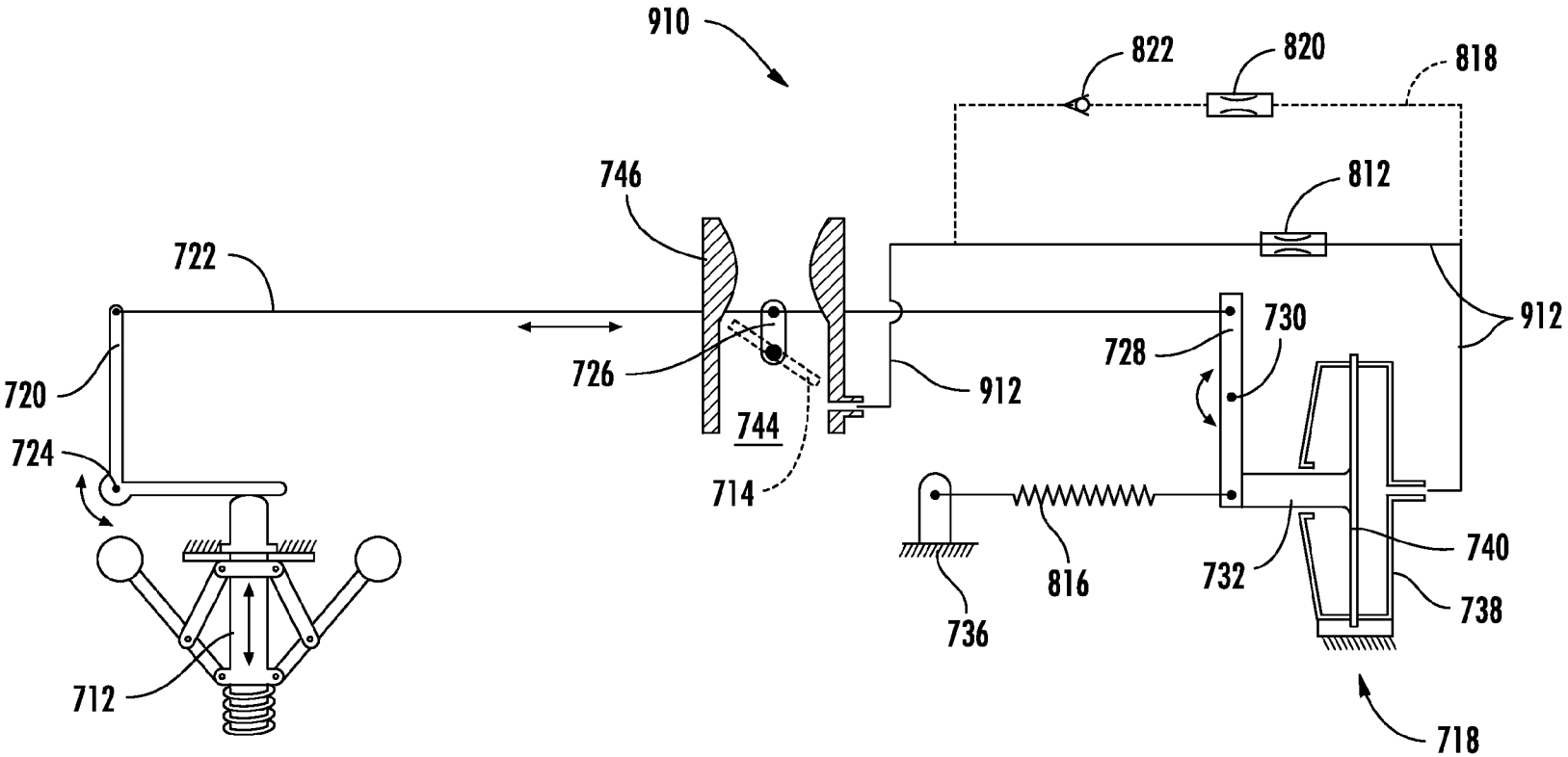
FIG. 11 is a schematic diagram of a control system according to yet another exemplary embodiment of the invention.

Referring to FIG. 11, a control system 910 for an engine including some components included in the control systems 710, 810, further includes a first conduit 912 that connects the actuator 718 to the air flow 744 after the air flow 744 has passed through the throttle plate 714, which is believed to improve efficiency of the control system 910 by reducing overshoot- and undershoot-type responses. The conduit 912 of control system 910 connects downstream of the throttle plate 714 (e.g., throttle valve), which changes the type of vacuum experienced by the actuator when compared to the vacuum experience by the conduits 742, 814 of systems 710 and 810, respectively, which rely upon ported vacuum, as opposed to manifold vacuum. Applicants believe that ported vacuum grows (pressure decreases relative to atmospheric) with increased opening of the throttle plate 714 while manifold vacuum decreases as the throttle plate 714 opens.

Figure 12:
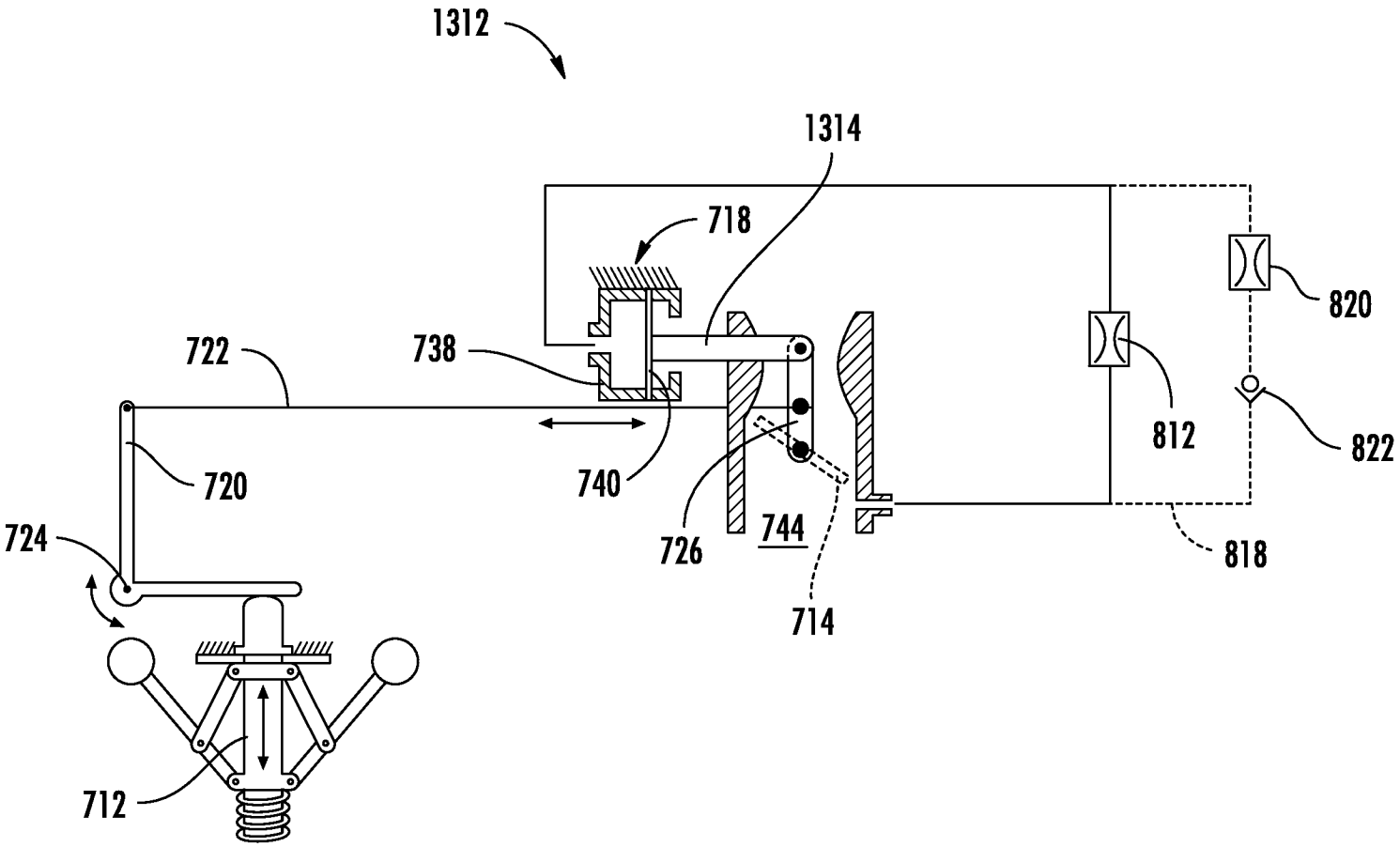
FIG. 12 is a schematic diagram of a control system according to another exemplary embodiment of the invention.
Figure 13:
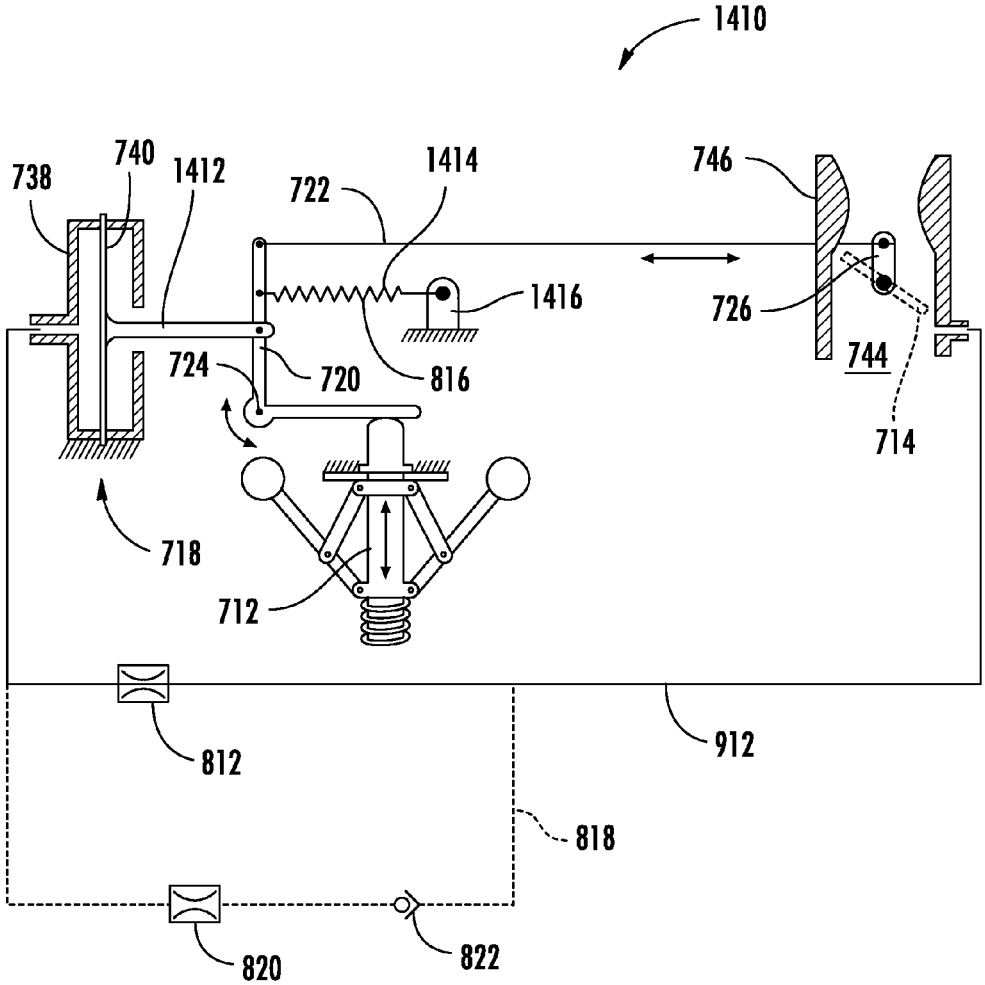
FIG. 13 is a schematic diagram of a control system according to yet another exemplary embodiment of the invention.

Referring to FIG. 12, a speed control system 1310 includes the governor 712 and associated components coupled to the throttle lever 726. Additionally, a conduit 1312 is connects the air of the intake manifold to the actuator 718, which is coupled directly to the throttle lever 726 by the rod 1314. Referring now to FIG. 13, a system 1410 includes the actuator 718 coupled directly to the governor arm 720 by a rod 1412. A spring 1414 anchored at a tang 1416 biases the governor arm 720. In still other embodiments, components of the systems 710, 810, 910, 1310, 1410 may be otherwise coupled and arranged, where components of one of the systems 710, 810, 910, 1310, 1410 may be added to others of the systems 710, 810, 910, 1310, 1410, double, tripled, removed, etc.

Figure 14:
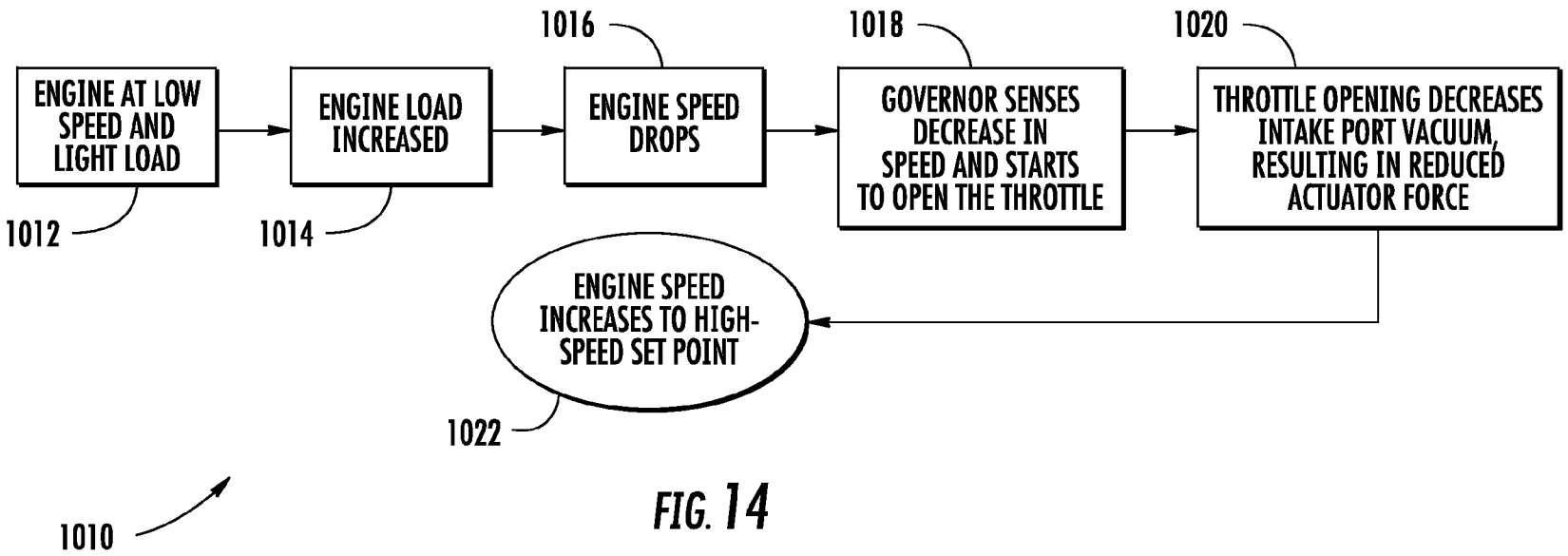
FIG. 14 is a first flow chart of a method of controlling engine speed according to an exemplary embodiment.
Figure 15:
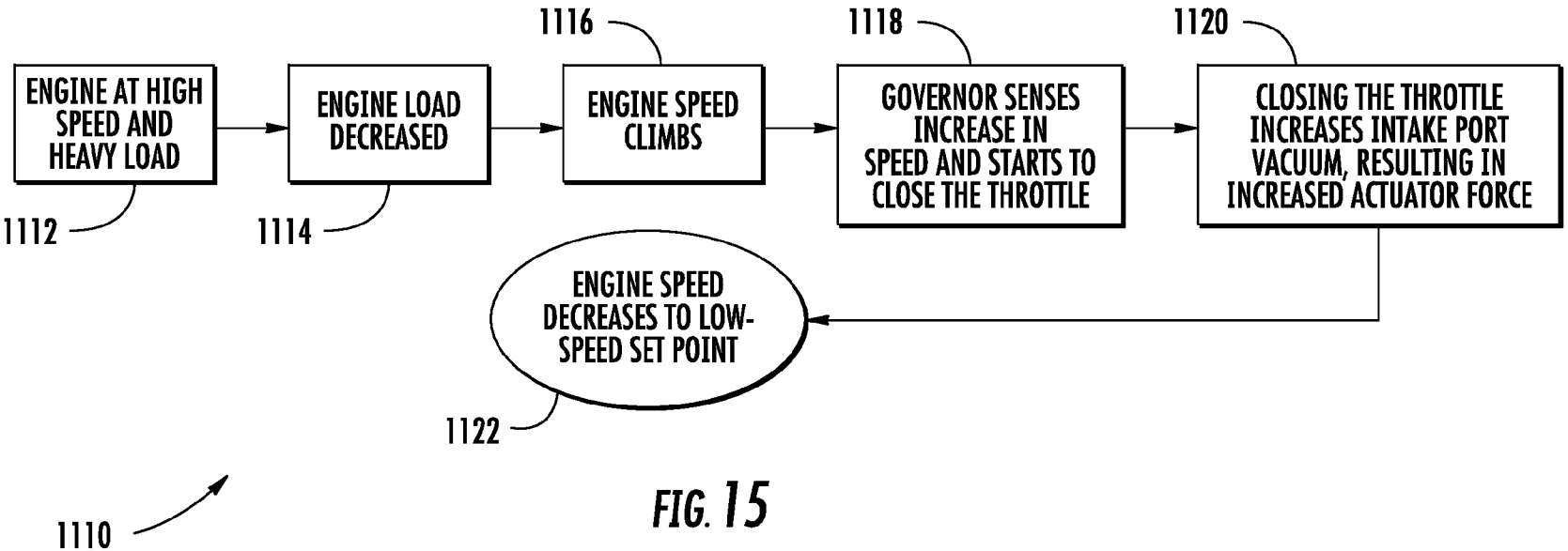
FIG. 15 is a second flow chart of the method of controlling engine speed of FIG. 14.

Referring to FIGS. 14-15 a process of controlling engine speed includes several steps. Referring to FIG. 14, an engine is transitioned from a light load configuration to a heavy load configuration according to process 1010. First, the engine is run at a light load and low speed (step 1012). Next, the load is increased, such as when a work implement is actuated (step 1014). As a result of the increased load, the engine speed decreases (e.g., "droop") (step 1016). A governor coupled to the engine senses the decrease in engine speed and begins opening a throttle of the engine (step 1018). As a result of opening the throttle, the intake manifold (e.g., intake port) vacuum is decreased. Decrease in engine vacuum is sensed by an actuator (e.g., sensor and actuator combination), which reduces force applied to the throttle (step 1020). As such, the engine speed increases to a high-speed set point (step 1022).

The process 1110 of FIG. 15 represents an engine transitioning from a heavy load configuration to a light load configuration. First, the engine is running at a high speed and heavy load (step 1112). As engine load is decreased (step 1114), the engine speed increases (step 1116). The governor senses the increased speed and starts to close the throttle (step 1118). However, closing the throttle increases the intake port vacuum, which increases the force applied to the throttle by the actuator (step 1120). As a result, the engine speed decreases to a low-speed set point (step 1122).

The construction and arrangements of the engines and power equipment, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An engine, comprising:

a throttle assembly configured to at least partially control a fuel flow rate of the engine, wherein the throttle assembly includes a throttle plate biased by a governor spring;

a governor configured to sense a speed of the engine and at least partially control the throttle assembly as a function of the engine speed;

an intake manifold;

an actuator configured to sense a manifold vacuum pressure at the intake manifold and at least partially control the throttle assembly as a function of the vacuum pressure, wherein the actuator operates to open the throttle plate in response to a low vacuum pressure and operates to close the throttle plate in response to a high vacuum pressure;

a first conduit coupling the intake manifold to the actuator; and a first restrictor positioned along the first conduit.

2. The engine of claim 1, wherein the governor and the actuator are each coupled to the governor spring of the throttle assembly.

3. The engine of claim 2, wherein the actuator comprises a diaphragm coupled to a mechanical linkage that is coupled to the governor spring of the throttle assembly, wherein the diaphragm translates the vacuum pressure into movement of the mechanical linkage, which loads the governor spring.

4. The engine of claim 3, further comprising:

a second conduit arranged in parallel with a portion of the first conduit;

a second restrictor positioned along the second conduit; and a check valve positioned along at least one of the first and second conduits.

5. The engine of claim 4, further comprising:

a crankshaft, wherein the governor comprises a flyweight rotatably coupled to the crankshaft.

6. The engine of claim 4, further comprising:

a blower fan configured to be driven at a rate proportional to the speed of the engine, wherein the governor comprises an air vane on a pivot, the air vane positioned proximate to the blower fan to receive air blown therefrom.

7. A control system for controlling the speed of an engine, comprising:

a throttle assembly configured to at least partially control a fuel flow rate of the engine, wherein the throttle assembly includes a throttle plate biased by a governor spring;

an actuator configured to sense a manifold vacuum pressure at an intake manifold of the engine; and a mechanical linkage configured to communicate between the actuator and the throttle assembly such that the actuator at least partially controls the throttle assembly as a function of the vacuum pressure of the engine, wherein the actuator operates to open the throttle plate in response to a low vacuum pressure and operates to close the throttle plate in response to a high vacuum pressure;

a first conduit coupling the intake manifold to the actuator; and a first restrictor positioned along the first conduit.

8. The system of claim 7, wherein the mechanical linkage includes an adjustable backstop for limiting movement of the linkage.

9. The system of claim 8, further comprising:

a second conduit arranged in parallel with a portion of the first conduit;

a second restrictor positioned along the second conduit; and a check valve positioned along at least one of the first and second conduits.

10. The system of claim 9, wherein the actuator comprises a diaphragm that translates the manifold vacuum pressure into movement of the mechanical linkage.

11. Power equipment, comprising:

a work implement; and an engine for driving the work implement, the engine comprising:

a throttle assembly configured to at least partially control a fuel flow rate of the engine, wherein the throttle assembly includes a throttle plate biased by a governor spring;

an intake manifold;

an actuator configured to sense a vacuum pressure at the intake manifold;

a linkage configured to communicate between the actuator and the throttle assembly such that the actuator at least partially controls the throttle assembly as a function of the vacuum pressure of the engine, wherein the actuator operates to open the throttle plate in response to a low vacuum pressure and operates to close the throttle plate in response to a high vacuum pressure;

a first conduit coupling the intake manifold to the actuator; and a first restrictor positioned along the first conduit.

12. The power equipment of claim 11, wherein the actuator comprises a diaphragm configured to translate the vacuum pressure into movement of the linkage.

13. The power equipment of claim 12, wherein the work implement includes at least one of an alternator, a water pump, a lawn mower blade, a tiller, and an auger.

14. The power equipment of claim 13, wherein the engine is a single-cylinder, four-stroke cycle, internal-combustion engine.

15. The power equipment of claim 11, wherein the linkage includes an adjustable backstop for limiting movement of the linkage.

16. The power equipment of claim 11, further comprising:

a second conduit arranged in parallel with a portion of the first conduit;

a second restrictor positioned along the second conduit; and a check valve positioned along at least one of the first and second conduits.

17. The power equipment of claim 11, wherein the first restrictor comprises one of a pneumatic damper and a pneumatic valve.

* * * * *